US012661557B2

(12) United States Patent
Van Der Velde

(10) Patent No.: US 12,661,557 B2
(45) Date of Patent: Jun. 23, 2026

(54) EASY-TO-DISASSEMBLE CONNECTOR AND SPORT TRAINING EQUIPMENT

(71) Applicant: DONG GUAN WEALTH SPORTING GOODS CO., LTD., Dongguan City (CN)

(72) Inventor: Jurgen Niko Johan Van Der Velde, Dongguan City (CN)

(73) Assignee: DONG GUAN WEALTH SPORTING GOODS CO., LTD., Dongguan City (CN)

( * ) Notice: Subject to any disclaimer, the term of this patent is extended or adjusted under 35 U.S.C. 154(b) by 65 days.

(21) Appl. No.: 18/672,899

(22) Filed: May 23, 2024

(65) Prior Publication Data

US 2025/0065194 A1 Feb. 27, 2025

(30) Foreign Application Priority Data

Aug. 21, 2023 (CN) ..... 202322243932.6

(51) Int. Cl.
*A63B 43/00* (2006.01)

(52) U.S. Cl.
CPC ..... *A63B 43/007* (2013.01)

(58) Field of Classification Search
CPC ..... A63B 43/007; A63B 41/04; A63B 41/085
See application file for complete search history.

(56) References Cited

U.S. PATENT DOCUMENTS 3,220,729 A * 11/1965 Whittington ..... A63B 43/007 473/610
4,192,044 A * 3/1980 Ballerini ..... A44C 5/20 24/607
5,236,383 A * 8/1993 Connelly ..... A63B 43/06 473/576
5,403,003 A * 4/1995 O'Hara ..... A63B 41/00 473/576
5,452,888 A * 9/1995 Glenn ..... A63B 43/007 473/576

(Continued)

FOREIGN PATENT DOCUMENTS

CN 202460050 U 10/2012
CN 214533919 U 10/2021

(Continued)

*Primary Examiner* — Eugene L Kim
(74) *Attorney, Agent, or Firm* — RABIN & BERDO, P.C.

(57) ABSTRACT

An easy-to-disassemble connector and sport training equipment has a first connecting assembly and a second connecting assembly that can be separated from or connected to each other. The first connecting assembly is connected to a rope, and the second connecting assembly is connected to a ball. The first connecting assembly has a first rotating-embedded unit, and the second connecting assembly has a second rotating-embedded unit connected to the first rotating-embedded unit. When the first rotating-embedded unit and the second rotating-embedded unit are connected to each other, it is convenient for the user to hold the rope to assist in sport trainings. When the first rotating-embedded unit and the second rotating-embedded unit are separated from each other, the first connecting assembly and the second connecting assembly are separated from each other and the ball can be used independently.

16 Claims, 7 Drawing Sheets

(56) References Cited

U.S. PATENT DOCUMENTS

| | | | | | |
|---|---|---|---|---|---|
| 5,611,540 | A * | 3/1997 | Williams | A63B 69/0079 | 473/573 |
| 5,913,739 | A * | 6/1999 | Brenneisen | A63B 43/007 | 473/417 |
| 7,137,914 | B1 * | 11/2006 | Boyer | A63B 43/007 | 473/575 |
| 2013/0059700 | A1 * | 3/2013 | Gilman | A63B 69/0073 | 482/121 |
| 2017/0095718 | A1 * | 4/2017 | Li | A63B 41/00 | |
| 2017/0319910 | A1 * | 11/2017 | Kroken | A63B 43/004 | |
| 2020/0030688 | A1 * | 1/2020 | Starne | A63B 67/10 | |

FOREIGN PATENT DOCUMENTS

| | | | | |
|---|---|---|---|---|
| DE | 202016105493 | U1 * | 10/2016 | A63B 43/007 |
| WO | WO-9810840 | A2 * | 3/1998 | A63B 21/0552 |

* cited by examiner

EASY-TO-DISASSEMBLE CONNECTOR AND SPORT TRAINING EQUIPMENT

BACKGROUND OF THE INVENTION

1. Field of the Invention

The present invention relates to sport equipment, especially to an easy-to-disassemble connector and sport training equipment.

2. Description of the Prior Arts

In physical education, physical training and fitness exercise, training equipment with ropes, such as tether ball, is usually adopted. However, the rope and the ball of the training equipment are usually fixedly connected to each other and cannot be separated, which makes it impossible to use the ball independently.

To overcome the shortcomings, the present invention provides an easy-to-disassemble connector to mitigate or obviate the aforementioned problems.

SUMMARY OF THE INVENTION

The main objective of the present invention is to provide an easy-to-disassemble connector that is configured to be connected to a rope and a ball.

The easy-to-disassemble connector has a first connecting assembly and a second connecting assembly, and the first connecting assembly and the second connecting assembly can be separated from or connected to each other. The first connecting assembly is configured to be connected to the rope, and the second connecting assembly is configured to be connected to the ball. The first connecting assembly includes a first rotating-embedded unit, and the second connecting assembly includes a second rotating-embedded unit. The second rotating-embedded unit is connected to the first rotating-embedded unit. When the first rotating-embedded unit and the second rotating-embedded unit are separated from each other, the first connecting assembly and the second connecting assembly are separated from each other and the ball can be used independently.

The first connecting assembly and the second connecting assembly are detachably connected to each other through the first rotating-embedded unit and second rotating-embedded unit plugged and rotatably connected. It is convenient to assemble and disassemble. In addition, when the first rotating-embedded unit and the second rotating-embedded unit are connected to each other, the user can hold the rope with ease to assist with sport trainings. When the first rotating-embedded unit and the second rotating-embedded unit are separated from each other, the ball can be used independently. Diversified uses help increase types of training in sports.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
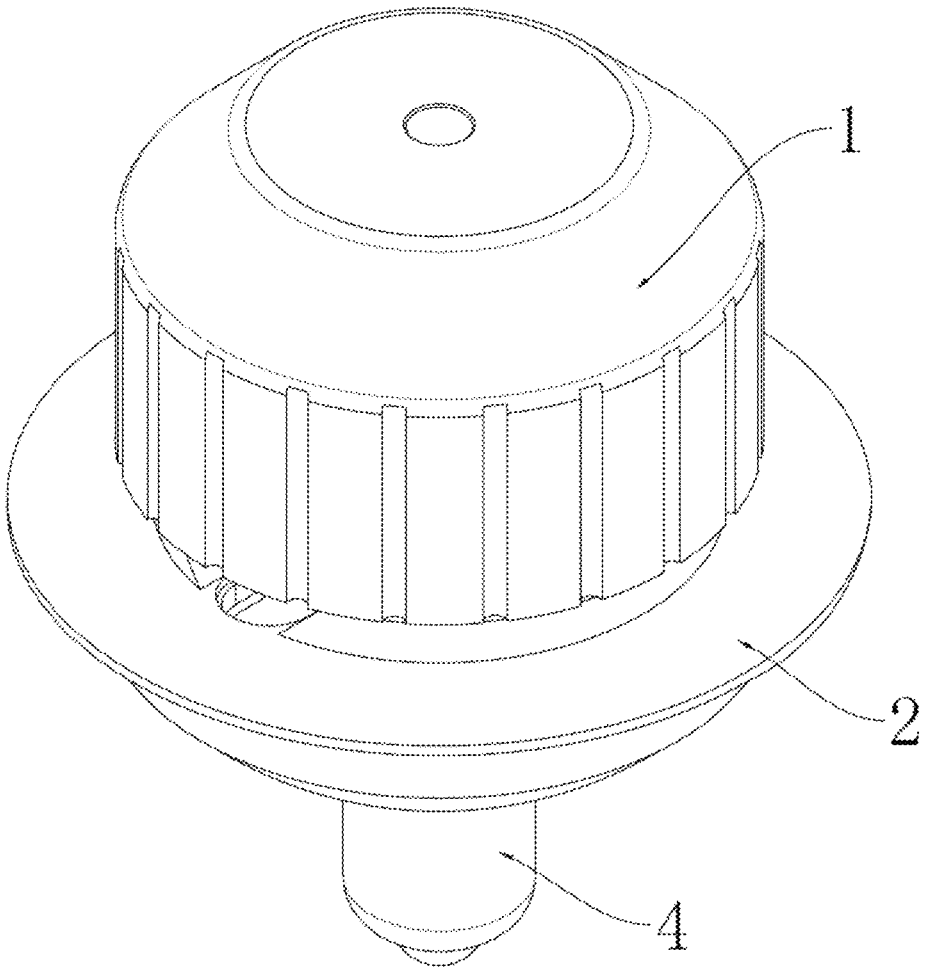
FIG. 1 is a perspective view of an easy-to-disassemble connector in accordance with the present invention.

With reference to FIG. 1 to FIG. 7, an easy-to-disassemble connector in accordance with the present invention includes a first connecting assembly 1 and a second connecting assembly 2 removably connected to each other. The first connecting assembly 1 is configured to be connected to a rope 5 and the second connecting assembly 2 is configured to be connected to a ball 6. The first connecting assembly 1 includes a first rotating-embedded unit 11 and the second connecting assembly 2 includes a second rotating-embedded unit 21. The second rotating-embedded unit 21 is connected to the first rotating-embedded unit 11 via rotating. When the first rotating-embedded unit 11 and the second rotating-embedded unit 21 are separated from each other, the first connecting assembly 1 and the second connecting assembly 2 are separated from each other and the ball 6 can be used independently.

Wherein an end of the rope 5 is configured to rotate with respect to the first connecting assembly 1, which can prevent the rope 5 from being twisted, or the first connecting assembly 1 can be fixedly connected to said end of the rope 5. The second connecting assembly 2 fixes and is connected to a surface of the ball 6. An outer surface of the second connecting assembly 2 is flush or nearly flush with the surface of the ball 6 to ensure that when the first connecting assembly 1 and the second connecting assembly 2 are separated, the second connecting assembly 2 will not affect the normal use of the ball 6.

The easy-to-disassemble connector realizes the detachable connection between the first connecting assembly 1 and the second connecting assembly 2 through the insertion and rotation of the first rotating-embedded unit 11 and the second rotating-embedded unit 21. Assembly and disassembly are both convenient, and also the user can hold the rope 5 with ease to assist with physical training when the first rotating-embedded unit 11 is connected to the second rotating-embedded unit 21. When the first rotating-embedded unit 11 and the second rotating-embedded unit 21 are separated from each other, the ball 6 can be used alone by the user. Diversified uses help increase types of training in sports.

With reference to FIG. 2 to FIG. 6, the first rotating-embedded unit 11 comprises an embedded pin 111 and the second rotating-embedded unit 21 comprises an embedded slot 211. The embedded slot 211 corresponds to the embedded pin 111.

Wherein the amount of the embedded pin 111 is preferably two. The two embedded pins 111 are symmetrically mounted on a lower end of the first rotating-embedded unit 1. Said lower end of the first rotating-embedded unit 1 refers to a direction closer to the ball 6. The amount of the embedded slot 211 and the amount of the embedded pin 111 are the same, and the embedded slot 211 and the embedded pin 111 are used in one-to-one correspondence, making the overall structural connection more stable when holding the rope 5 for training. The insertion and rotation of the first rotating-embedded unit 11 and the second rotating-embedded unit 21 are realized through the embedded pin 111 and the embedded slot 211. The structure is simple and reliable and is easy to assemble and disassemble.

Figure 2:
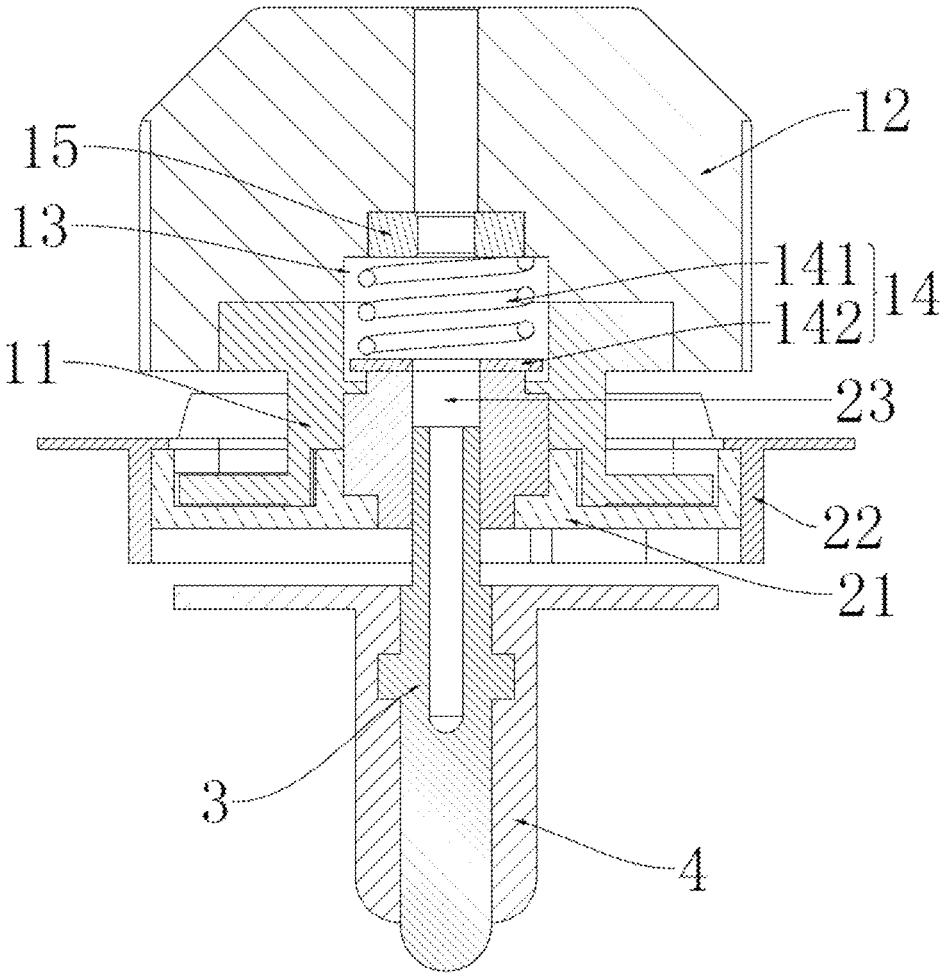
FIG. 2 is a sectional view of the easy-to-disassemble connector in FIG. 1.
Figure 3:
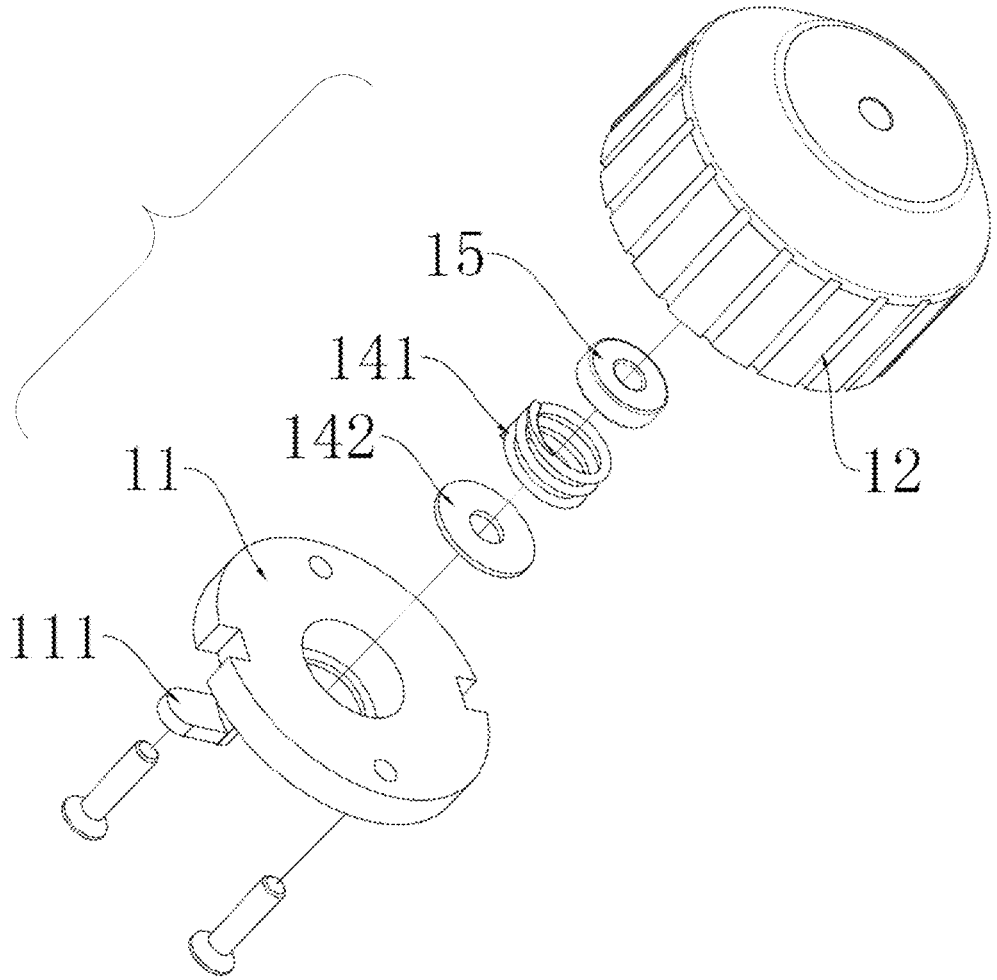
FIG. 3 is an exploded view of the first connecting assembly of the easy-to-disassemble connector in FIG. 1.
Figure 4:
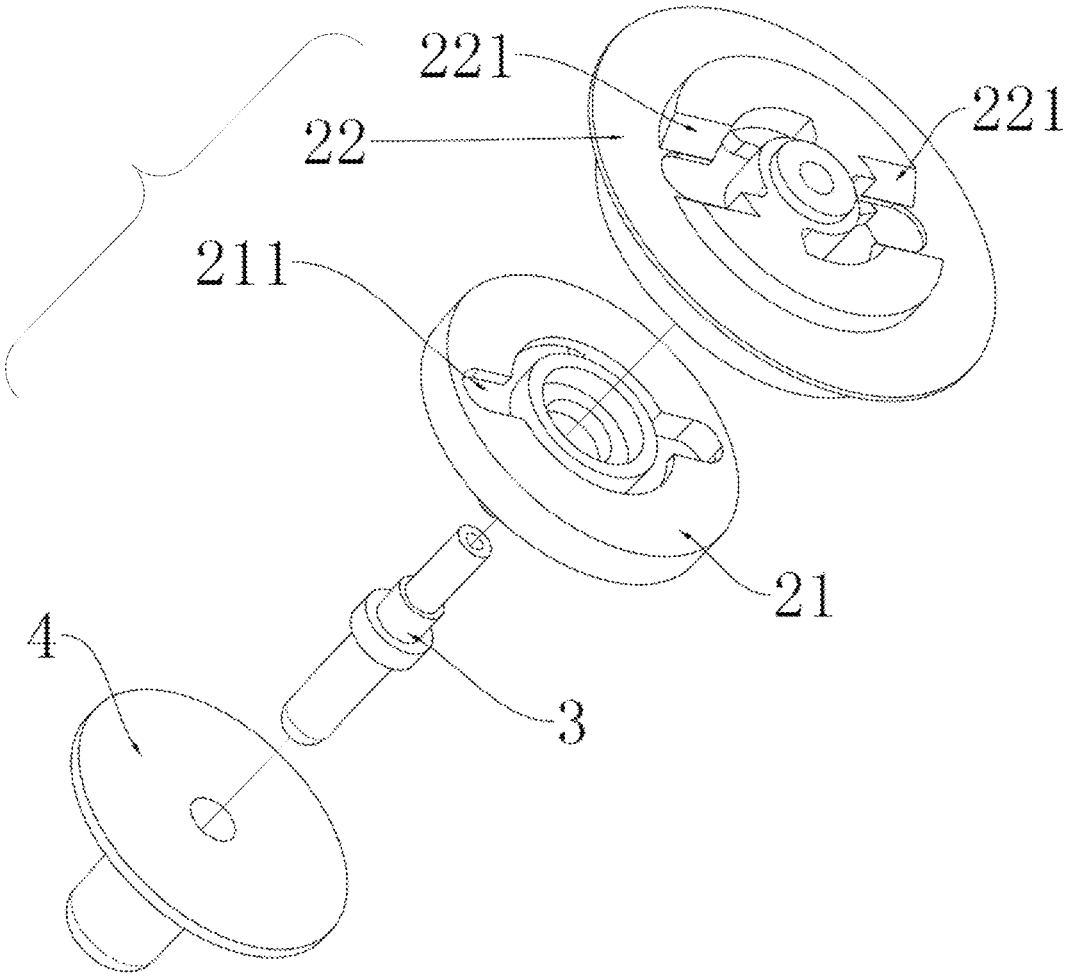
FIG. 4 is an exploded view of the second connecting assembly of the easy-to-disassemble connector with part of the ball in FIG. 1.

With reference to FIG. 2 to FIG. 4, the second connecting assembly 2 also includes a sleeve 22 wrapped around the second rotating-embedded unit 21. The second rotating-embedded unit 21 is connected to the ball 6 via the sleeve 22. The material of the sleeve 22 is preferably rubber. The sleeve 22 and the surface of the ball 6 can be integrally formed, or can be connected and fixed to each other by bonding. The second connecting assembly 2 is connected to the ball 6 via the sleeve 22, such that the second connecting assembly 2 and the ball 6 have better integration and the structure is more integrated.

With reference to FIG. 4, the sleeve 22 comprises a guiding surface 221, and the guiding surface 221 is mounted on an entrance of the embedded slot 211 to facilitate the embedded pin 111 to smoothly slide into the embedded slot 211 and achieve a smooth connection with the embedded slot 211.

With reference to FIG. 2 to FIG. 4, a part of a ball bladder 4 is shown in the figures. The ball 6 comprises an air inlet 3 for inflating and deflating the ball 6. The second connecting assembly 2 comprises a hole 23 fluidly communicating with the air inlet 3. The hole 23 is located on the sleeve 22 and apart from the two embedded slots 211, such that there is no structural interference. Two ends of the air inlet 3 are connected to the ball bladder 4 and the hole 23 respectively. A valve is inserted into the air inlet 3 through the hole 23 to perform inflation and deflation operations, thereby integrating the air inlet 3 and the second connecting assembly 2 into one structure.

Figure 6:
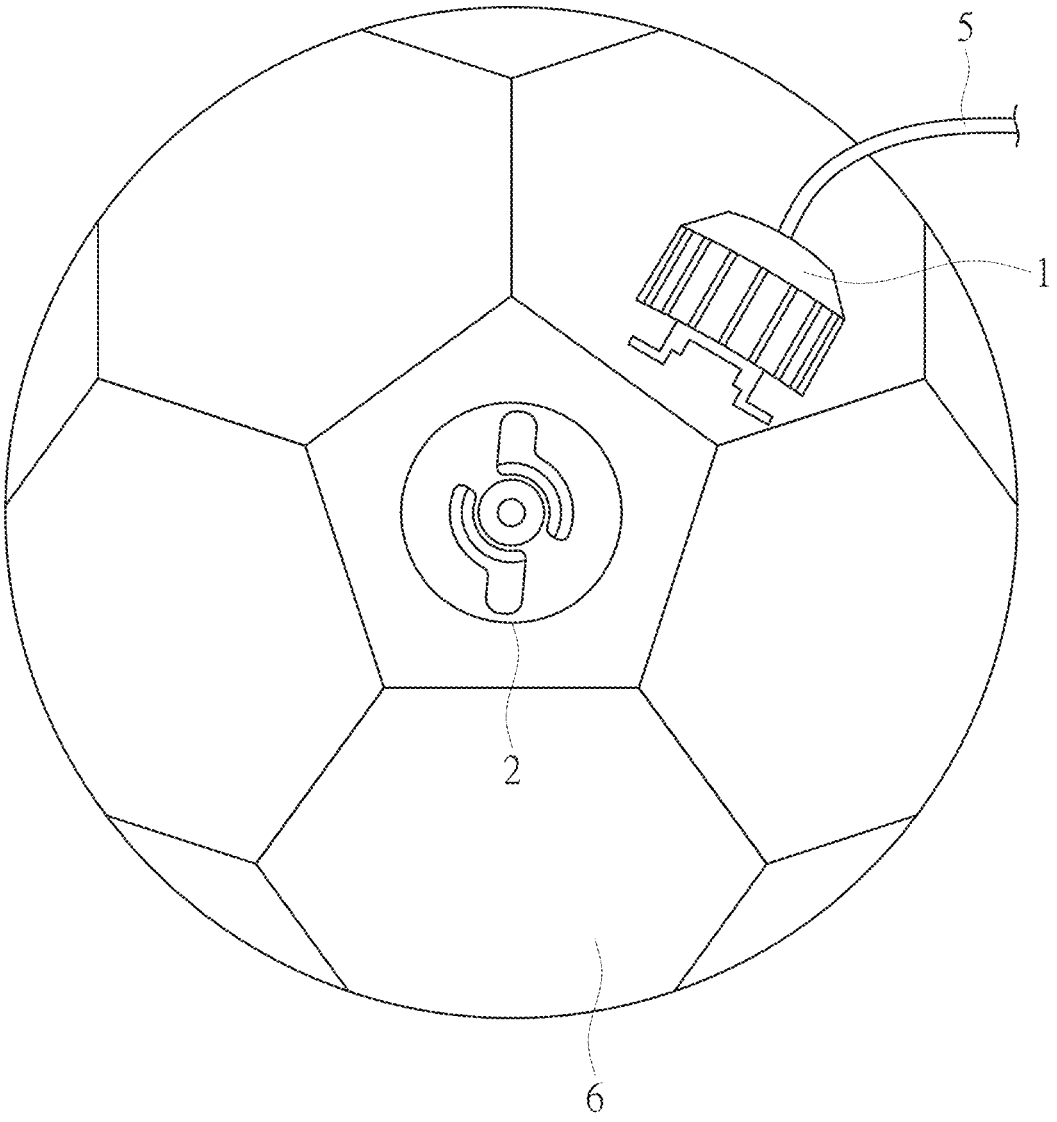
FIG. 6 is a top view of the sport training equipment in accordance with the present invention.
Figure 7:
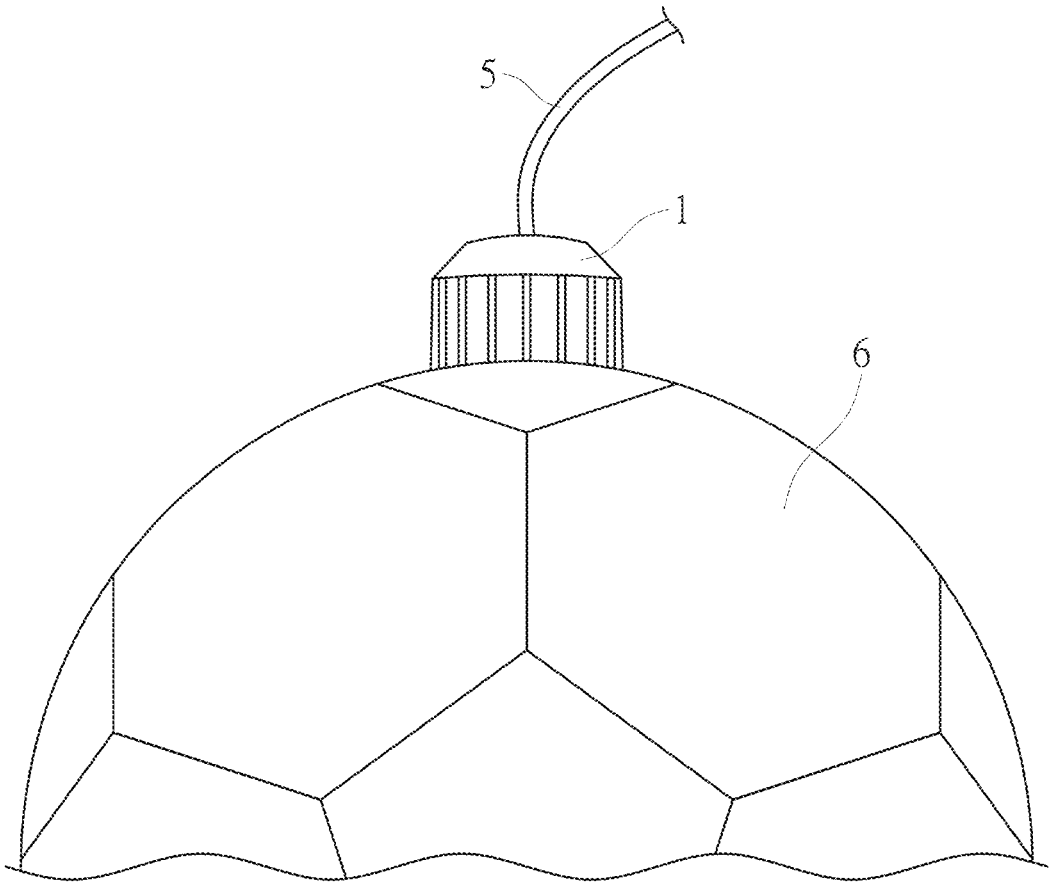
FIG. 7 is a front view of the sport training equipment in FIG. 6.

With reference to FIG. 6 and FIG. 7, in this embodiment, this design that combines a hole created by the air inlet 3 and a hole created by the second connecting assembly 2 into one hole can prevent the inflation needle from being mistakenly inserted into the connecting hole, making it easier to use. By reducing one hole, the ball 6 is made as close as to the regulated specifications, allowing users to effectively improve their skills through the sports training equipment of this embodiment. In addition, the chance of hitting the hole with the user's foot when dribbling or the chance of the hole on the ball 6 contacting the ground will be significantly reduced. Combining two holes into one allows for a better user experience and increases the reliability of assessing and improving skills.

With reference to FIG. 1 to FIG. 4, and FIG. 6, the first connecting assembly 1 also includes a connector casing 12 connected to the first rotating-embedded unit 11. The connector casing 12 is configured to be connected to the rope 5. An installation cavity 13 is formed between the connector casing 12 and the first rotating-embedded unit 11. An elastic assembly 14 in contact with the second connecting assembly 2 is mounted in the installation cavity 13. When the first rotating-embedded unit 11 is connected to the second rotating-embedded unit 21, the elastic assembly 14 is in contact with the second connecting assembly 2.

Wherein the connector casing 12 and the first rotating-embedded unit 11 are connected and fixed to each other with screws. When the first connecting assembly 1 needs to be assembled and connected with the second connecting assembly 2, the embedded pin 111 is first inserted into the embedded slot 211 by external force. At this time, the elastic assembly 14 is in contact with the sleeve 22, and the elastic assembly 14 is compressed and generates an elastic force. Then the embedded pin 111 is rotated in the embedded slot 211 to realize the connection. After the external force is removed, the embedded pin 111 can firmly contact the embedded slot 211 through the elastic force of the elastic assembly 14. This ensures that the embedded pin 111 is not easily rotated and detached from the embedded slot 211, and also ensures the stability of the sports training equipment during use.

The elastic assembly 14 includes a spring 141 and a washer 142. Two ends of the spring 141 are connected to the washer 142 and the installation cavity 13 respectively. The washer 142 is connected to the installation cavity 13 and can move upwards or downwards relative to the installation cavity 13, and the washer 142 is configured to contact the second connecting assembly 2. A bottom of the installation cavity 13 comprises a stopper to prevent the washer 142 from falling off. When the first connecting assembly 1 needs to be assembled and connected with the second connecting assembly 2, the embedded pin 111 is first inserted into the embedded slot 211 by external force. At this time, the washer 142 is in contact with the sleeve 22, and the spring 141 is compressed and generates an elastic force. Then the embedded pin 111 is rotated in the embedded slot 211 to realize the connection. After the external force is removed, the embedded pin 111 can firmly contact the embedded slot 211 through the elastic force of the spring 14. This ensures that the embedded pin 111 is not easily rotated and detached from the embedded slot 211, and also ensures the stability of the sports training equipment during use. When the first connecting assembly 1 needs to be separated from the second connecting assembly 2, the first connecting assembly 1 is compressed downwards by external force to resist the elastic force of the spring 141. Therefore, the embedded pin 111 can be separated from the embedded slot 211 and rotate out, so the ball 6 can be used alone.

With reference to FIG. 2, FIG. 3, and FIG. 7, the connector casing 12 comprises a bearing 15 connected to the rope 5. The bearing 15 can ensure that the rope 5 rotates relative to the ball 6 during the rotation of the ball 6, thereby preventing the rope 5 from being twisted and ensuring that the rope 5 always remains in a stretched state.

Figure 5:
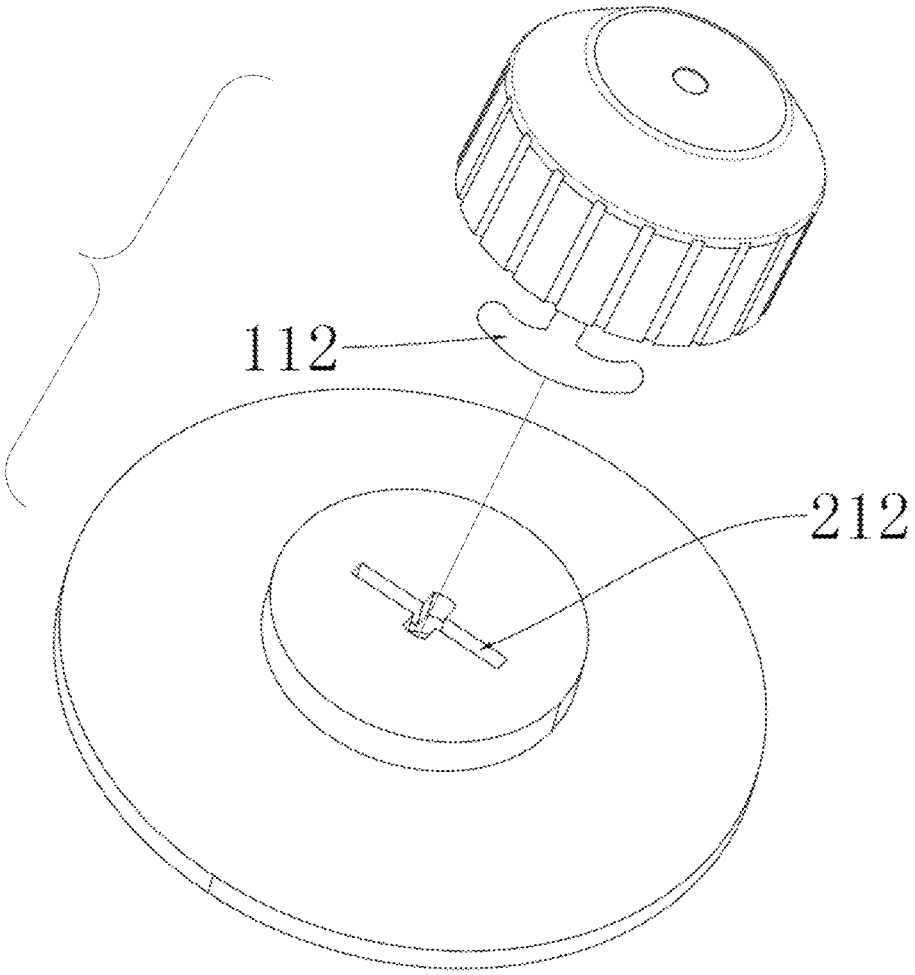
FIG. 5 is part of an exploded view of another embodiment of the easy-to-disassemble connector.

With reference to FIG. 5, in another embodiment, the embedded pin 111 is a T-shaped unit 112 and the embedded slot 211 is a straight slot 212.

In the embodiment, there are one T-shaped unit 112 and one corresponding straight slot 212. The overall structure is simple and reliable. When the first connecting assembly 1 needs to be connected to the second connecting assembly 2, align and insert the T-shaped unit 112 to the straight slot 212. Then, the T-shaped unit 112 is rotated 90° horizontally and inserted into a slot perpendicular to the straight slot 212. Therefore, the first connecting assembly 1 is firmly connected to the second connecting assembly 2.

With reference to FIG. 6 and FIG. 7, the sport training equipment in accordance with the present invention is configured to include an easy-to-disassemble connector mentioned above.

In the sport training equipment of this embodiment, the first connecting assembly 1 and the second connecting assembly 2 are detachably connected to each other through the first rotating-embedded unit 11 and second rotating-embedded unit 21 plugging and rotatably connected. The sport training equipment is convenient to assemble and disassemble. In addition, when the first rotating-embedded unit 11 and the second rotating-embedded unit 21 are connected to each other, the user can hold the rope 5 with ease to assist in sport trainings. When the first rotating-embedded unit 11 and the second rotating-embedded unit 21 are separated from each other, the ball 6 can be used independently. Diversified uses help increase types of training in sports.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An easy-to-disassemble connector configured to connect a rope and a ball; the easy-to-disassemble connector including:

a first connecting assembly configured to be connected to the rope; the first connecting assembly including:

a first rotating-embedded unit; and a connector casing connected to the first rotating-embedded unit; the connector casing being configured to be connected to the rope;

a second connecting assembly configured to be connected to the ball; the second connecting assembly including:

a second rotating-embedded unit connected to the first rotating-embedded unit by rotating;

an installation cavity formed between the connector casing and the first rotating-embedded unit; and an elastic assembly mounted in the installation cavity and abutting against the second connecting assembly;

wherein the first connecting assembly and the second connecting assembly are capable of separating from or being connected to each other;

wherein when the first rotating-embedded unit and the second rotating-embedded unit are separated from each other, the first connecting assembly and the second connecting assembly are separated from each other and the ball is available for use individually; and wherein when the first rotating-embedded unit is connected to the second rotating-embedded unit, the elastic assembly abuts against the second connecting assembly.

2. The easy-to-disassemble connector as claimed in claim 1, wherein the first rotating-embedded unit comprises an embedded pin, and the second rotating-embedded unit comprises an embedded slot corresponding to the embedded pin.

3. The easy-to-disassemble connector as claimed in claim 1, wherein the second connecting assembly also includes a sleeve surrounding the second rotating-embedded unit, and the second rotating-embedded unit is connected to the ball through the sleeve.

4. The easy-to-disassemble connector as claimed in claim 2, wherein the second connecting assembly also includes a sleeve surrounding the second rotating-embedded unit, and the second rotating-embedded unit is connected to the ball through the sleeve.

5. The easy-to-disassemble connector as claimed in claim 3, wherein the sleeve comprises a guiding surface.

6. The easy-to-disassemble connector as claimed in claim 4, wherein the sleeve comprises a guiding surface.

7. The easy-to-disassemble connector as claimed in claim 1, wherein the ball comprises an air inlet, and the second connecting assembly comprises a hole fluidly communicating with the air inlet.

8. The easy-to-disassemble connector as claimed in claim 6, wherein the ball comprises an air inlet, and the second connecting assembly comprises a hole fluidly communicating with the air inlet.

9. The easy-to-disassemble connector as claimed in claim 1, wherein the elastic assembly includes a spring and a washer; two ends of the spring connected to the washer and the installation cavity respectively; the washer being moveable up and down with respect to the installation cavity and contacting the second connecting assembly.

10. The easy-to-disassemble connector as claimed in claim 8, wherein the elastic assembly includes a spring and a washer; two ends of the spring connected to the washer and the installation cavity respectively; the washer being moveable up and down with respect to the installation cavity and contacting the second connecting assembly.

11. The easy-to-disassemble connector as claimed in claim 1, wherein the connector casing comprises a bearing connected to the rope.

12. The easy-to-disassemble connector as claimed in claim 10, wherein the connector casing comprises a bearing connected to the rope.

13. The easy-to-disassemble connector as claimed in claim 2, wherein the embedded pin is a T-shaped unit and the embedded slot is a straight slot.

14. The easy-to-disassemble connector as claimed in claim 12, wherein the embedded pin is a T-shaped unit and the embedded slot is a straight slot.

15. Sport training equipment including an easy-to-disassemble connector as claimed in claim 1.

16. Sport training equipment including an easy-to-disassemble connector as claimed in claim 14.

* * * * *